US009945647B2

(12) United States Patent
Pugliese et al.

(10) Patent No.: US 9,945,647 B2
(45) Date of Patent: Apr. 17, 2018

(54) SELF LOCKING BROADHEAD BLADE

(71) Applicants: Carl Pugliese, Chandler, AZ (US); Ronald E. Way, Overgaard, AZ (US)

(72) Inventors: Carl Pugliese, Chandler, AZ (US); Ronald E. Way, Overgaard, AZ (US)

( * ) Notice: Subject to any disclaimer, the term of this patent is extended or adjusted under 35 U.S.C. 154(b) by 0 days.

(21) Appl. No.: 15/187,777

(22) Filed: Jun. 21, 2016

(65) Prior Publication Data

US 2016/0370158 A1 Dec. 22, 2016

Related U.S. Application Data

(60) Provisional application No. 62/182,561, filed on Jun. 21, 2015.

(51) Int. Cl.
*A63B 65/02* (2006.01)
*F42B 6/08* (2006.01)

(52) U.S. Cl.
CPC ..... *F42B 6/08* (2013.01); *A63B 2244/04* (2013.01)

(58) Field of Classification Search
CPC .... F42B 6/08; F42B 12/34; F42B 6/04; F42B 12/362; F42B 12/385; F42B 12/365; F42B 10/08; F42B 10/46
USPC ..... 473/583; 7/128
See application file for complete search history.

(56) References Cited

U.S. PATENT DOCUMENTS

| | | | | |
|---|---|---|---|---|
| 5,322,297 | A | 6/1994 | Smith | |
| 5,765,247 | A * | 6/1998 | Seber | B25F 1/003 30/161 |
| 6,200,237 | B1 | 3/2001 | Barrie | |
| 6,517,454 | B2 | 2/2003 | Barrie et al. | |
| 6,910,979 | B2 | 6/2005 | Barrie et al. | |
| 7,771,298 | B2 | 8/2010 | Pulkrabek | |
| 2001/0036876 | A1* | 11/2001 | Barrie | F42B 6/08 473/583 |
| 2015/0094175 | A1* | 4/2015 | Sullivan | F42B 6/08 473/583 |

* cited by examiner

*Primary Examiner* — Gene Kim
*Assistant Examiner* — Christopher Glenn
(74) *Attorney, Agent, or Firm* — James L Farmer

(57) ABSTRACT

Designs and methods are provided for a retractable broadhead blade. In one exemplary embodiment the broadhead blade is configured to be received in a slot in a broadhead body, and moveable between a retracted or in-flight position, and a deployed or target penetrating position. The broadhead blade includes a front end that faces substantially forward when the blade is in the retracted position, a distal end opposite the front end, an outward facing sharpened leading edge between the front end of the blade and the distal end, and an inward facing trailing edge opposite the leading edge. The blade further includes an integral spring member with a contact surface configured to bear against a blade locating portion of a broadhead body when the blade is in the retracted, or in-flight position.

23 Claims, 5 Drawing Sheets

SELF LOCKING BROADHEAD BLADE

TECHNICAL FIELD AND BACKGROUND

The technical field of the present invention relates generally to broadheads, a well known type of arrowhead, and more particularly to an expanding broadhead, a type of broadhead with an in-flight configuration in which the blades are retracted, and upon striking a target converts to a deployed, or target penetrating position in which the blades are expanded outward.

DESCRIPTION OF THE EMBODIMENTS

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
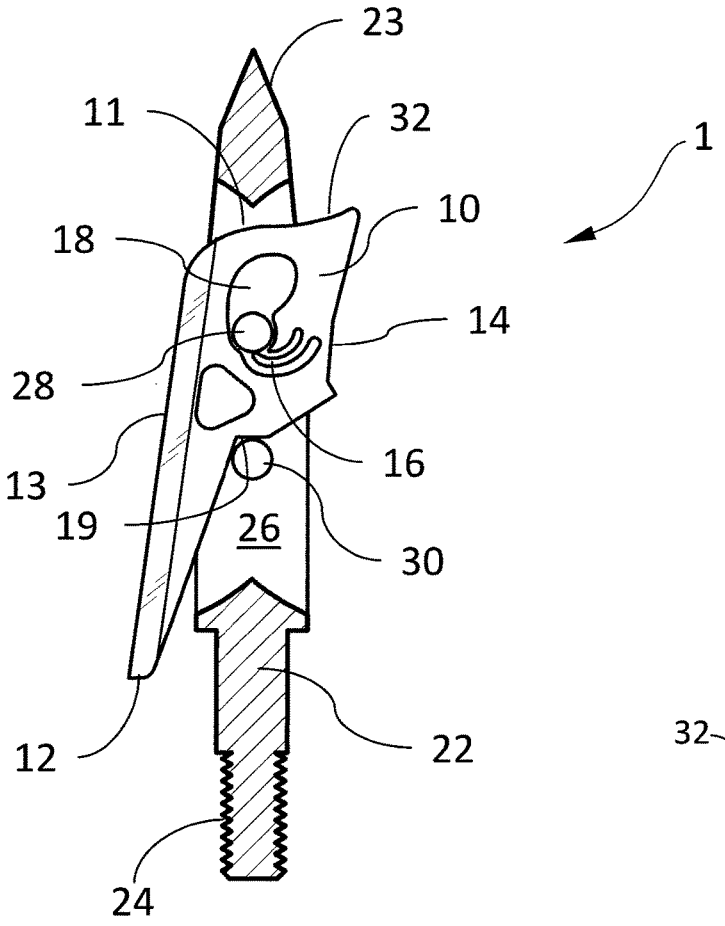
FIG. 1 is a cut-away side view of a broadhead in accordance with the present invention, with a portion of the broadhead body removed to show a single self-locking blade in the retracted, or in-flight position.
Figure 2:
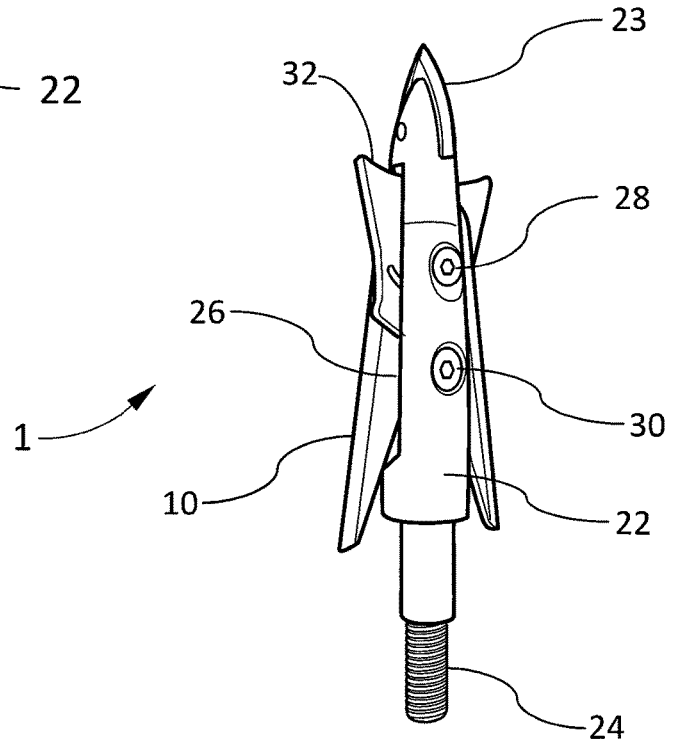
FIG. 2 is a perspective side view of a fully assembled two-bladed broadhead in accordance with the invention, with the self-locking blades locked in the retracted position.
Figure 3:
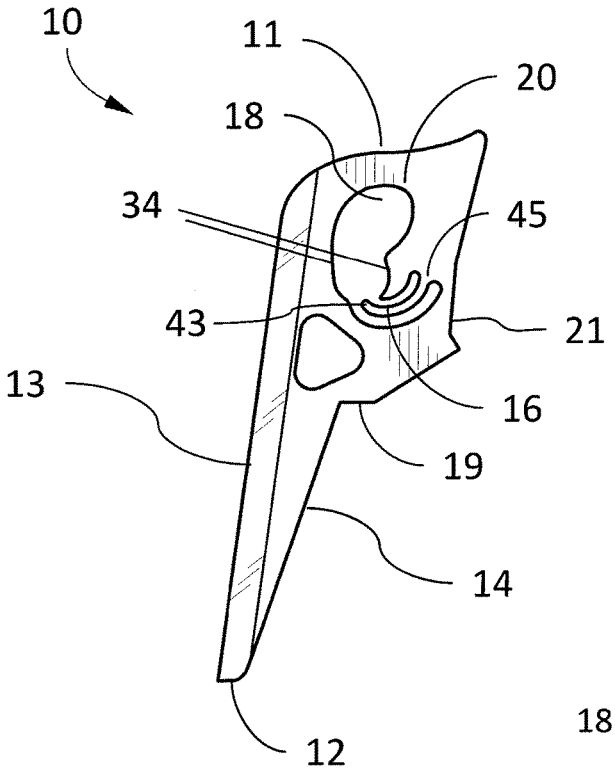
FIG. 3 is a front view the self-locking blade of FIG. 1.

Referring now specifically to the drawings, a broadhead and self-locking broadhead blade in accordance with one exemplary embodiment of the present disclosure are illustrated in FIGS. 1 through 3, and indicated generally at reference numerals 1 and 10. Beginning with FIG. 1, a broadhead blade 10 is shown assembled to a broadhead body 22. Only one blade is shown for clarity of illustration in several of the drawings, including FIG. 1, although a broadhead in accordance with the present disclosure would typically have a symmetrical configuration including at least two expanding blades, such as the fully assembled configuration of FIG. 2.

Figure 11:
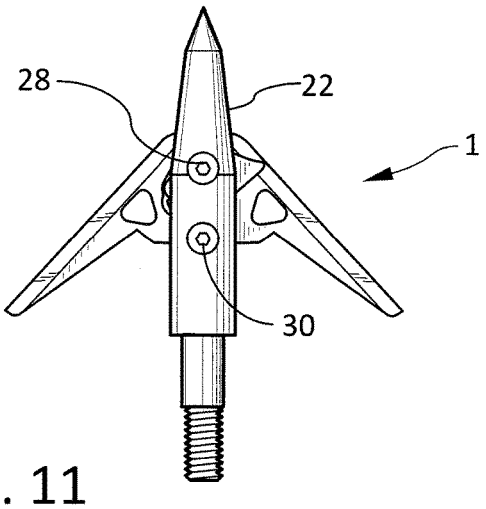
FIG. 11 is a side view of a complete two-bladed broadhead, also with the self-locking blades shown in the deployed position.

The broadhead body 22 may be similar in certain respects to prior art designs, including a target penetrating end or tip 23 at the front, an arrow shaft attachment end 24 at the back, and a longitudinal passage or slot 26 for receiving one or more blades. A blade retaining lug 28 and a blade locking lug 30 traverse the slot 26 substantially perpendicular to a longitudinal axis of the broadhead body. The blade retaining lug 28 is positioned forward of the locking lug 30 in slot 26, or in other words closer to the penetrating end 23 of broadhead body. The lugs 28, 30 may be any type of cylindrical member or bar, such as press-fit metal dowel pins, screws, rivets, or the like that are installed in holes or recesses formed in the broadhead body. Alternatively the lugs may be fabricated as integrally formed portions of the broadhead body. In one particular embodiment the lugs are steel rivets (see FIGS. 2 and 11) installed in holes that are simply cross-drilled through the broadhead body 22.

The broadhead blade 10 has a perimeter defined by a front end 11, a distal end 12, an outward facing, sharpened leading edge 13 between the front end and distal end, and a trailing edge 14 opposite the leading edge. In the retracted blade position of FIGS. 1 and 2, the front end 11 faces generally forward, and includes a target contacting portion 32 that extends out from the broadhead body. The target contacting portion 32 is on an opposite side of the broadhead body 22 relative to the distal end 12 as shown in FIG. 1, however the blade could also be configured with the contacting portion 32 and distal end on the same side of body 22.

The broadhead blade further includes an aperture 18 that captures the blade retaining lug 28 as shown, thereby functioning cooperatively with lug 28 to effectively retain the blade to the broadhead body. The aperture 18 has a contour that includes a deployed blade retaining surface 20 in a forward portion of the contour proximate the front end 11 of the blade, and a blade locating pocket 34 in an aft portion of the aperture contour substantially opposite the forward portion. The blade locating pocket 34 is configured to substantially restrict lateral movement of the blade 10 relative to the blade retaining lug 28 with the blade retracted.

Figure 4:
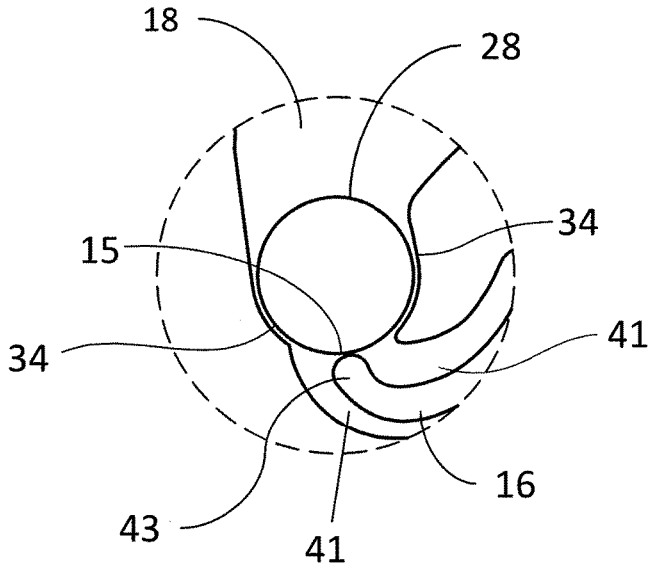
FIG. 4 is a close-up view of the portion of FIG. 1 proximate a blade locking lug of the broadhead body.

Referring now also to FIG. 4, blade 10 further incorporates a locking system with an integral spring member 16 configured to bear against one of the blade retaining lug 28 or locking lug 30 when the blade is in the retracted, in-flight position. The spring member 16 may be integrally formed from the blade material, such as for example stainless steel, or fabricated as a separate element attached with conventional methods such as by bonding or welding.

The depicted locking system embodiment is intended to represent a spring member integrally formed from the blade material by forming or cutting a pair of adjacent grooves 41 through the blade. The grooves 41 essentially cooperate to define a spring in the form of an elongated, flexible bar that extends into the aperture 18, or more specifically into the pocket 34 portion of aperture 18, from a cantilevered end 45 to a free end 43. The grooves may be parallel and arcuate in shape to produce the curved spring shape depicted, although other shapes such as straight, angled, or a zig-zag pattern are also feasible. In any case, a contact surface 15 at the free end is configured to bear against the blade retaining lug 28 when the blade is in the retracted position.

The spring member 16 works in conjunction with the locking surface 19 in the blade trailing edge to restrain the blade in the retracted position. To that end, spring member 16 is configured to create an interference fit so that in order for the locking surface 19 in the blade trailing edge to be forced over the blade locking lug 30, the spring member must be deflected toward the distal end 12 of the blade. This deflection results in a forwardly directed force being exerted against the blade retaining lug 28 by the spring member, and an equal and opposite force being exerted by locking surface 19 against the blade locking lug 30.

Figure 5:
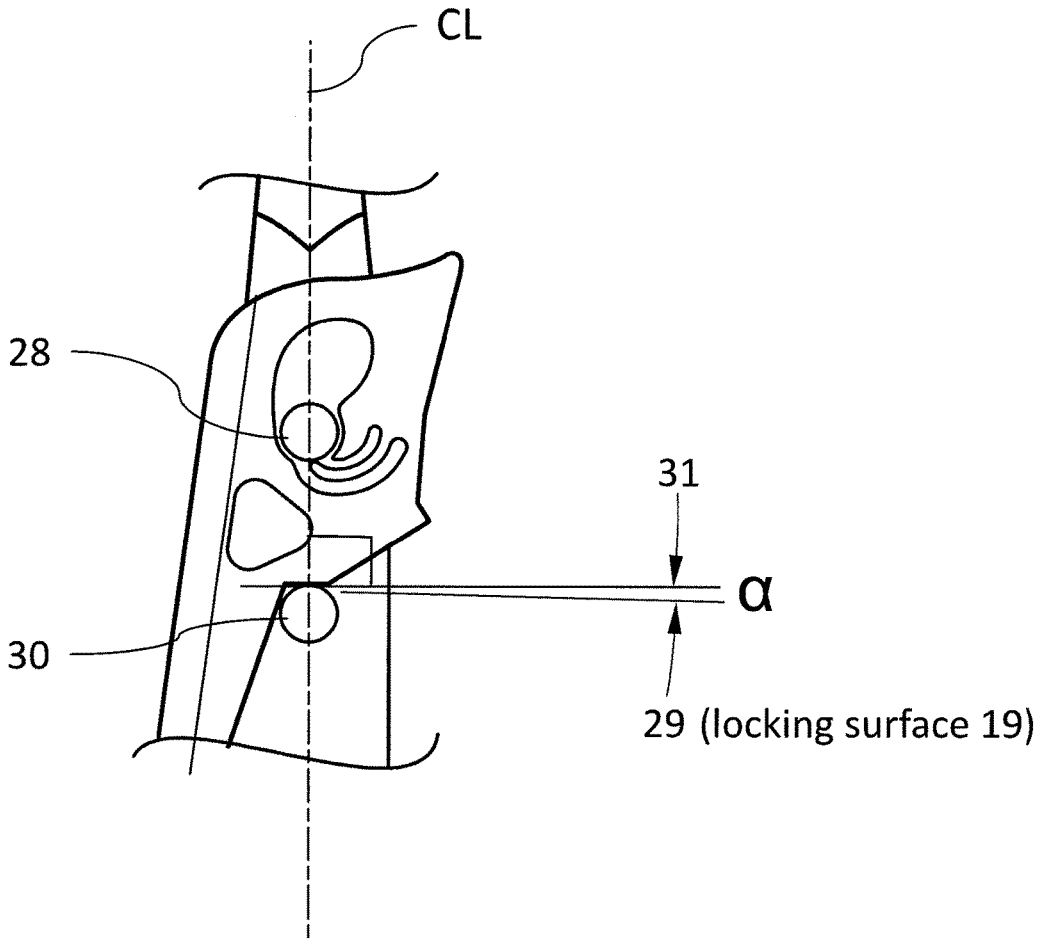
FIG. 5 is another close-up view of the broadhead of FIG. 1 illustrating a ramp angle of a locking surface in the trailing edge of the self-locking blade.

Referring to FIG. 5, the locking surface 19 may be configured with a ramp angle $\alpha$. The ramp angle $\alpha$ is the angle between a line 29 defined by the locking surface 19, and a perpendicular line 31 to a line "CL" passing through the center of lugs 28 and 30. The ramp angle is selected to have sufficient slope to prevent the blade from unintentionally slipping off the locking lug 30 during arrow flight or from normal handling, while still allowing the blade to come off of the locking lug when the blade strikes a target. In one embodiment the ramp angle is between about zero and five degrees, and in another more particular embodiment the ramp angle is about one degree.

Although in the depicted embodiments the spring member 16 engages the blade retaining lug 28 in the aperture 18, other configurations are possible. For example, the spring member may instead be located on the blade trailing edge, and configured to bear against (from above or below) the blade locking lug 30. In such a configuration the spring member could incorporate a ramp angle or a detent feature to double as a blade locking surface.

It should be further appreciated that still other configurations and orientations of the spring member and/or locking surface may be beneficially utilized, any of which would be well within the spirit and scope of the invention. Generally stated, the blade retention system may be arranged in any manner that provides a first contact surface on an integral spring configured to bear against a first lug or blade locating feature of a broadhead body, and a second contact surface on the blade configured to bear against a second lug or blade locating feature of the broadhead body, such that the spring must be deflected or compressed for the blade to be placed in the retracted position in which the first and second contact surfaces are bearing against the respective first and second blade locating features.

Figure 6:
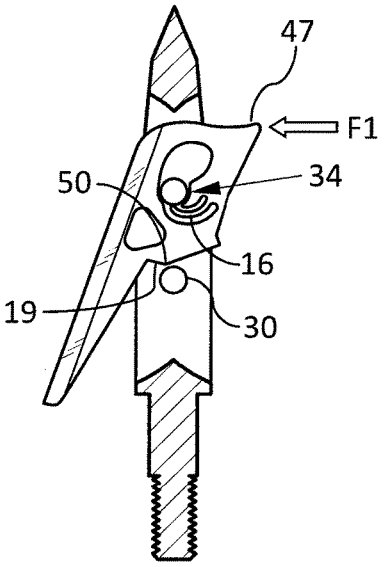
FIGS. 6 through 8 illustrate a process of moving the self-locking blade from an unlocked position into the locked, or retracted position.
Figure 7:
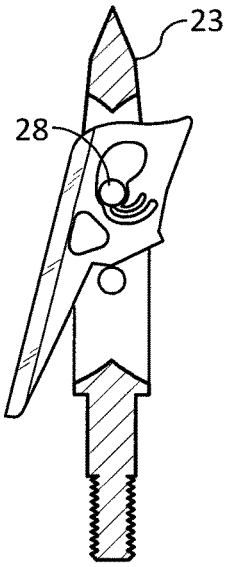
Figure 8:
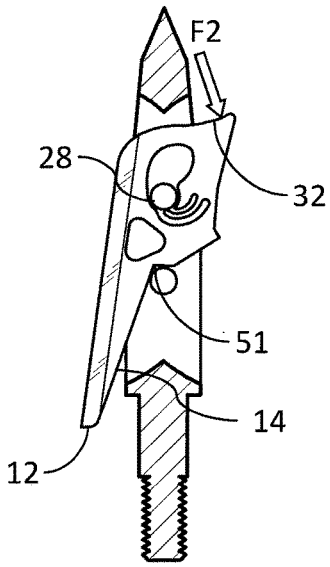

The process of placing the blades in the retracted or in-flight position is illustrated by the sequence of FIGS. 6-8. FIG. 6 depicts the blade 10 in an unlocked position wherein an outer corner 50 of locking surface 19 rests against the the side of locking lug 30, and the spring member 16 rests against the blade retaining lug 28. The lug 28 is near the bottom or aft portion of the aperture 18 in the blade locating pocket 34. In this position the spring is undeflected, and there is no force being exerted against either of lugs 28 and 30 by the blade.

The blade may be moved toward the locked position by applying a lateral force "F1" to the forward outer corner 47 of the blade forward end 11. In a fully assembled broadhead with two blades, the lateral force may be conveniently applied by pinching the two corners 47 together. The applied force F1 is reacted at lug 28 against one side of the blade locating pocket 34, creating a couple tending to rotate the blade. For the single depicted blade, the reaction force is against the right side of the locating pocket 34, and the direction of the applied couple is counterclockwise, tending to drive outer corner 50 of the locking surface 19 against lug 30.

By applying enough force, the corner 50 of the locking surface will begin to ride up on lug 30, pushing the blade in a forward direction toward the broadhead tip 23, and causing the spring member 16 to deflect in a rearward direction as it bears against lug 28. With sufficient continued force the blade rotation will continue, overcoming the resisting force of the spring member, while the locking surface 19 moves forward and laterally onto lug 30. FIG. 7 depicts an interim condition in which the blade has rotated counterclockwise far enough to move the outer corner 50 to the forward side of lug 30 approximately coincident with a line through the centers of lugs 28 and 30 (see line CL in FIG. 5). In this condition the spring member 16 is at its maximum rearward deflection, and the lug 28 is at its rear-most position within the blade locating pocket 34.

FIG. 8 shows the end result of continued application of force F1, with the blade rotated to the fully retracted position, and lug 30 seated in the inner corner 51 of the locking surface with the trailing edge 14. In this position the spring member is still deflected rearward, applying a forward directed force to lug 28, with an equal and opposite reaction force in a rearward direction being applied by locking surface 19 to lug 30. This force between surface 19 and lug 30 created by spring member 16 together with the previously described ramp angle of surface 19, tends to keep lug 30 seated in corner 51, and laterally stabilized.

At the same time the forward end of the blade is laterally restrained and stabilized by the blade locating pocket 34. As best seen in FIG. 4, the lateral width of the blade locating pocket is only slightly greater than the diameter of lug 28. In one embodiment the width of blade locating pocket 34 measured adjacent the middle of lug 28 is between about 0.001 and 0.010 inches greater than the diameter of lug 28.

Figure 9:
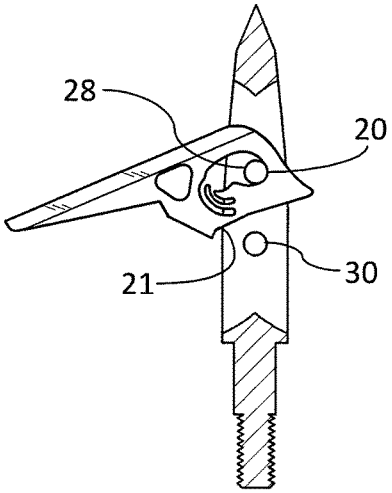
FIG. 9 is a side view of the broadhead of FIG. 1 showing the blade in a hyper-extended position that occurs after contact with a target.

The above described blade locking sequence is essentially reversed when the broadhead strikes a target and the blades deploy. Referring initially still to FIG. 8, upon initial target penetration, the contacting portion 32 of the blade is forced against the target, creating a wedging force against the blade at an outwardly directed angle. The wedging force (Indicated by arrow "F2") is reacted laterally at lug 28, creating a clockwise couple or torque tending to rotate the blade clockwise about lug 28, and swing the distal end of the blade 12 outward and away from the broadhead body 22. The applied torque is resisted by friction between the locking surface 19 and lug 30 due to the interference fit of the blade against the lugs combined with ramp angle of locking surface 19. However, as the momentum of the arrow continues driving the broadhead forward, the wedging force eventually overcomes the friction at lug 30, and the blade abruptly releases from lug 30 swinging rapidly and freely outward. The rotational momentum of the swinging blade initially carries it out to a hyper-extended position shown in FIG. 9, unguided in the process by either of lugs 28 and 30. In this position the contact between the blade and the broadhead body is at the blade retaining lug 28, and specifically where the blade retaining surface 20 at the forward portion of aperture 18 bears against the blade retaining lug 28.

Figure 10:
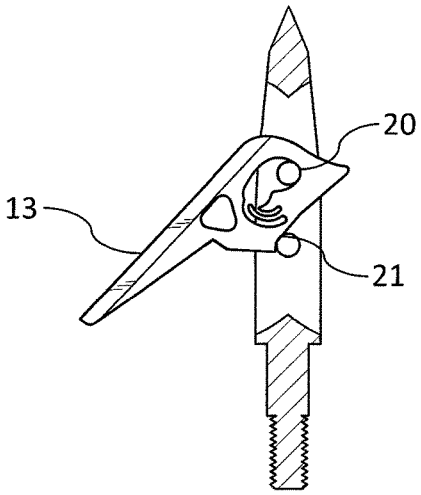
FIG. 10 is a side view of the broadhead of FIG. 1 showing the blade in the deployed position.

As the broadhead continues to penetrate further into the target, the blade leading edge 13 eventually contacts the target, pushing the blade rearward and causing it to rotate counterclockwise, back toward the broadhead body. The rotation will continue until the blade again comes into contact with lug 30 at a blade bracing surface or notch 21 in the blade trailing edge 14, as depicted in the deployed configuration of FIGS. 10 and 11. In this blade position the combination of the blade bracing surface 21 bearing against lug 30, together with the blade retaining surface 20 bearing against lug 28, act to brace the blade and prevent any further inward rotational movement. The blades will remain in the braced, deployed position and cut through the target for as far as momentum carries the broadhead forward. As in prior art broadheads, the blades are free to swing forward, allowing the broadhead to be pulled backward out of the target without any barbing effect.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. A broadhead blade configured to be received in a slot in a broadhead body and moveable between a retracted or in-flight position and a deployed or target penetrating position, the broadhead blade comprising:

a front end that faces substantially forward when the blade is in the retracted position, and a distal end opposite the front end;

an outward facing sharpened leading edge between the front end and the distal end, and an inward facing trailing edge opposite the leading edge;

an aperture with a contour defining a blade retaining surface in a portion of the aperture proximate the front end of the blade, the blade retaining surface configured to bear against a blade retaining lug of a broadhead body when the blade is in the deployed position, and an integral spring member portion of the blade that extends into the aperture proximate a portion of the aperture contour nearest the distal end of the blade, the integral spring member having a contact surface configured to bear against a blade retaining lug of a broadhead body when the blade is in the retracted position, creating an interference wherein the spring member portion of the blade must be deflected relative to the blade to overcome the interference and place the blade in the retracted position.

2. The broadhead blade of claim 1, further comprising a locking surface located in the trailing edge between the aperture and the distal end of the blade, the locking surface configured to bear against a blade locking lug of a broadhead body when the blade is in the retracted position.

3. The broadhead blade of claim 2, wherein the integral spring member and the locking surface are positioned relative to one another such that when the blade is mounted in a broadhead body and positioned with the integral spring against a blade retaining lug of a broadhead body, the integral spring must be deflected in order for the locking surface to be forced over a blade locking lug of the broadhead body and place the blade in the retracted position.

4. The broadhead blade of claim 3, wherein when the blade is installed on a broadhead body and in the retracted position, the locking surface is configured to be at a ramp angle to a perpendicular to a line extending through a center of a blade retaining lug and a blade locking lug of the broadhead body.

5. The broadhead blade of claim 4, wherein the ramp angle is about 1 degree.

6. The broadhead blade of claim 1, wherein the integral spring member is a flexible bar with a fixed end integral with the blade, and a free end at the contact surface.

7. The broadhead blade of claim 6, wherein a portion of the perimeter of the spring member is defined by grooves that extend through the blade.

8. The broadhead blade of claim 1, further comprising a blade locating pocket in a portion of the aperture contour proximate the contact surface of the integral spring member, the blade locating pocket configured to substantially restrict lateral movement of the blade relative to a blade retaining lug of a broadhead body when the blade is in the retracted position.

9. The broadhead blade of claim 2, further comprising a bracing surface in the trailing edge between the locking surface and the front end, the bracing surface configured to abut a locking lug of a broadhead body when the blade is in the deployed position.

10. A broadhead comprising:

a broadhead body having a forward end with a tip, an aft end for attachment to an arrow shaft, and a longitudinally extending blade slot traversed by a blade retaining lug;

a blade received in the slot and moveable between a retracted or in-flight position, and a deployed or target penetrating position, the blade comprising:

a front end that faces substantially forward when the blade is in the retracted position, and a distal end opposite the front end;

an outward facing sharpened leading edge between the front end and distal end, and an inward facing trailing edge opposite the leading edge; and an integral spring member portion of the blade with a contact surface configured to bear against the blade retaining lug when the blade is in the retracted position, creating an interference wherein the spring member portion of the blade must be deflected relative to the blade to overcome the interference and place the blade in the retracted position.

11. The broadhead of claim 10, further comprising:

a blade locking lug in the blade slot in the broadhead body; and a locking surface located in the blade trailing edge and configured to bear against the blade locking lug when the blade is in the retracted position.

12. The broadhead of claim 11, wherein the integral spring member and the locking surface are positioned relative to one another such that the integral spring member must be deflected in order for the locking surface to be forced over the blade locking lug and place the blade in the retracted position.

13. The broadhead of claim 12, wherein the locking surface is configured to be at a ramp angle to a perpendicular to a line extending through a center of the blade retaining lug and a center of the blade locking lug.

14. The broadhead of claim 13, wherein the ramp angle is between zero and five degrees.

15. The broadhead of claim 10, wherein the integral spring member is a flexible bar with a fixed end integral with the blade, and a free end at the contact surface.

16. A broadhead blade configured to be received in a slot in a broadhead body, and moveable between a retracted or in-flight position, and a deployed or target penetrating position, the broadhead blade comprising:

a front end that faces substantially forward when the blade is in the retracted position, and a distal end opposite the front end;

an outward facing sharpened leading edge between the front end of the blade and the distal end, and an inward facing trailing edge opposite the leading edge;

an integral spring member portion of the blade with a first contact surface configured to bear against a first blade locating portion of a broadhead body when the blade is in the retracted position, creating an interference wherein the spring member portion of the blade must be deflected relative to the blade to overcome the interference and place the blade in the retracted position.

17. The broadhead blade of claim 16, further comprising a second contact surface configured to bear against a second blade locating portion of the broadhead body and cause the spring member to deflect when the blade is in the retracted position.

18. The broadhead blade of claim 17, further comprising an aperture with a contour defining a blade retaining surface in a portion of the aperture proximate the front end the blade, the blade retaining surface configured to bear against a blade retaining lug in a broadhead body when the blade is in the deployed position.

19. The broadhead blade of claim 18, wherein the integral spring member extends into the aperture.

20. The broadhead blade of claim 19, wherein the second contact surface is in the trailing edge between the aperture and the distal end of the blade.

21. The broadhead blade of claim 20, further comprising a blade locating pocket in a portion of the aperture contour proximate the integral spring member, the blade locating pocket configured to substantially restrict lateral movement of the blade relative to a blade retaining lug of a broadhead body when the blade is in the retracted position.

22. The broadhead blade of claim 16, wherein the integral spring member is a flexible bar with a fixed end integral with the blade, and a free end at the contact surface.

23. A broadhead blade comprising a first contact surface on an integral spring portion of the blade configured to bear against a first blade locating feature of a broadhead body, and a second contact surface on the blade configured to bear against a second blade locating feature of the broadhead body, such that the integral spring portion of the blade must be deflected relative to the blade for the blade to be placed in a retracted position in which first and second contact surfaces are bearing against the respective first and second blade locating features of the broadhead body.

* * * * *